US005966747A

United States Patent [19]

Crupi et al.

[11] Patent Number: 5,966,747

[45] Date of Patent: Oct. 19, 1999

[54] PROTECTIVE SUIT WITH GROIN PROTECTOR

[75] Inventors: Vince Crupi, Ottawa; Donald Alexander Gunn, Orleans; Richard J. L'Abbé , Ottawa; Aristidis Makris, Nepean; Ron Purvis, Orleans; Kalaam Shaik, Nepean, all of Canada

[73] Assignee: Med-Eng Systems Inc., Ottawa, Canada

[21] Appl. No.: 09/070,713

[22] Filed: Apr. 30, 1998

[51] Int. Cl.[6] ..... F41H 1/02

[52] U.S. Cl. ..... 2/466; 2/2.5; 2/455; 2/463

[58] Field of Search ..... 2/455, 456, 463, 2/464, 465, 466, 22, 227, 404, 2.5

[56] References Cited

U.S. PATENT DOCUMENTS

| | | | |
|---|---|---|---|
| H7 | 1/1986 | Martone | 2/2.5 |
| D. 302,623 | 8/1989 | Robinson . | |
| D. 320,475 | 10/1991 | Jeter, Jr. . | |
| D. 369,454 | 5/1996 | Olsen . | |
| D. 392,437 | 3/1998 | Duval . | |
| D. 403,487 | 1/1999 | Crupi et al. . | |
| 1,277,706 | 9/1918 | Dorfman . | |
| 1,381,254 | 6/1921 | Thorp | 2/466 |
| 2,471,071 | 5/1949 | McDonald . | |
| 3,034,131 | 5/1962 | Lent . | |

(List continued on next page.)

FOREIGN PATENT DOCUMENTS

| | | | |
|---|---|---|---|
| 53615 | 11/1984 | Canada . | |
| 54622 | 6/1985 | Canada . | |
| 58013 | 2/1987 | Canada . | |
| 60621 | 4/1988 | Canada . | |
| 1189670 | 10/1959 | France | 2/466 |
| 525809 | 8/1957 | Italy | 2/466 |

OTHER PUBLICATIONS

United States Statutory Invention Registration No. H7 Published Jan. 7, 1986 Martone.

Med–Eng Systems Inc. "EOD–7B Explosive Disposal Suit" dated Oct. 1997.

Belgium Security Systems SC, "Protection—Search Suit" published before the filing date Apr. 30, 1998.

Protech EOD Protection "Search Suit PCTCMS III, Countermine Suit PTCMS IV, Bomb Disposal Suit" published before the filing date Apr. 30, 1998.

Safeco EOD, Incorporated, "PA–915 Explosive Ordnance Disposal Search Suit" published before the filing date Apr. 30, 1998.

Med–Eng Systems "EOR–2 Plus Search Suit" published before the filing date Apr. 30, 1998.

Safeco EOD 2000 "Explosive Ordance Disposal Suit" published before the filing date Apr. 30, 1998.

Armor Holdings, Inc. "Explosive Ordnance Disposal" published before the filing date Apr. 30, 1998.

MAAVRIM "Danger Mines!" published before the filing date Apr. 30, 1998.

*Primary Examiner*—Gloria Hale
*Assistant Examiner*—Tejash D Patel
*Attorney, Agent, or Firm*—Merchant & Gould P.C.

[57] ABSTRACT

A protective suit for covering the limbs and body of an operative to shield them from the effects of explosive devices such as anti-personnel mines includes on the front thereof an upper reinforced breast plate and a lower reinforced groin plate to provide added protection to the vital organs of the wearer. In the deployed position the groin plate at its upper end overlaps the lower end of the breast plate, and the lower end of the groin plate extends in front of and below the crotch region of the wearer. The groin plate is movable upwardly to a retracted position within a pouch in front of the breast plate, and in this retracted position does not interfere with the freedom of movement of the wearer's legs.

17 Claims, 2 Drawing Sheets

U.S. PATENT DOCUMENTS

| | | | |
|---|---|---|---|
| 3,345,641 | 10/1967 | Jennings . | |
| 3,422,458 | 1/1969 | Schueller . | |
| 3,788,314 | 1/1974 | Noreen | 128/159 |
| 4,079,464 | 3/1978 | Roggin | 2/2.5 |
| 4,497,069 | 2/1985 | Braunhut . | |
| 4,580,296 | 4/1986 | Cano . | |
| 4,639,944 | 2/1987 | Lashley et al. . | |
| 4,805,143 | 2/1989 | Gibbens et al. . | |
| 4,805,243 | 2/1989 | Gibbens et al. | 2/223 |
| 4,811,427 | 3/1989 | Regan | 2/404 |
| 4,993,076 | 2/1991 | Dierickx | 2/2 |
| 5,060,314 | 10/1991 | Lewis | 2/2.5 |
| 5,239,706 | 8/1993 | Stevenson | 2/408 |
| 5,274,854 | 1/1994 | Wenner et al. . | |
| 5,465,424 | 11/1995 | Cudney et al. . | |
| 5,704,071 | 1/1998 | Barclay et al. . | |
| 5,718,003 | 2/1998 | Gwinn . | |

PROTECTIVE SUIT WITH GROIN PROTECTOR

BACKGROUND OF THE INVENTION

1. Field of the Invention

This invention relates to a new or improved groin protector for a protective suit and to a protective suit including such groin protector.

The invention is particularly although not exclusively applicable to the types of protective suits commonly employed by personnel involved in bomb disposal and mine clearance operations.

2. Description of the Prior Art

Protective equipment provided for individuals involved in such hazardous duties as mine clearance and bomb disposal is required to provide to the wearer a degree of overall protection from fragmentation and blast effects. This requires the provision of special footwear, gauntlets and head gear, as well as a suit which offers a degree of protection to the limbs, torso, neck and head of the wearer, while also providing enhanced protection to the wearer's vital organs and spine. It is essential that any such suit provides an adequate level of protection without unduly inhibiting the freedom of movement of the wearer, since the wearer must still be able to move about and perform various tasks involved in his duties.

SUMMARY OF THE INVENTION

The invention provides a protective suit for covering the body and limbs of an operative to shield them from the effects of explosive devices such as anti-personnel mines and the like, said suit having on the front thereof a reinforced groin plate that has a deployed position wherein it is disposed in front of the groin region of the wearer and extends from the waist to below the crotch region with an upper end of said groin plate being in register with the lower end of a chest protector that is carried on the front of said suit, said groin plate being selectively displaceable upwardly by the wearer to a retracted position wherein it provides less inhibition to the freedom of movement of the legs of the wearer, particularly when bending down, kneeling, leaning over, etc.

Preferably in the deployed position the groin plate is angled or curved rearwardly downwardly so that its lower end is in proximity to the legs of the wearer, the lower part of the groin plate tapering in width to a rounded lower end.

The groin plate may be positioned within and connected at its bottom to a pouch of flexible material, the pouch extending in front of and below the breast plate, and being readily foldable to permit the groin plate to be raised upwardly from the deployed position into a retracted position wherein it overlies the breast plate. The groin plate can be retained in the retracted position through frictional engagement with the breast plate, the pouch material, width restrictions or otherwise.

Alternatively, the arrangement can be such that some additional means, e.g. a force applied by the hand or arm of the wearer of the suit, may be required to retain the groin plate in the retracted position, removal of such force allowing the groin plate to descend to the deployed position under the force of gravity.

In another possible arrangement the interengagement between the groin plate and the pouch may be selected to be such that when the pouch is tilted, as when the wearer is crouched over or leans forward, the groin plate will remain in the retracted position and when the wearer straightens up so that the groin plate is in a more upright position it can slide down to the deployed position under the force of gravity. However in some circumstances, e.g. where the suit is tight fitting, some manual assistance may be necessary to move the groin plate down to the fully deployed position.

Although it is preferred that the groin plate whether deployed or retracted overlaps the chest protector on the outside, it could equally well be positioned to overlap the chest protector on the rear side, i.e. to be at all times closer to the body of the wearer than is the chest protector.

The amount of overlap between the upper edge of the groin plate and the lower ends of the chest protector when the groin plate is deployed must be sufficient to prevent penetration of fragments between the two. As a practical matter therefore the minimum amount of overlap must be 10 mm, and while the overlap may be as much as 50 mm, it is preferably approximately 25 mm.

BRIEF DESCRIPTION OF THE DRAWINGS

The invention will further be described, by way of example only, with reference to the accompanying drawings wherein.

DESCRIPTION OF THE PREFERRED EMBODIMENTS

Figure 1:
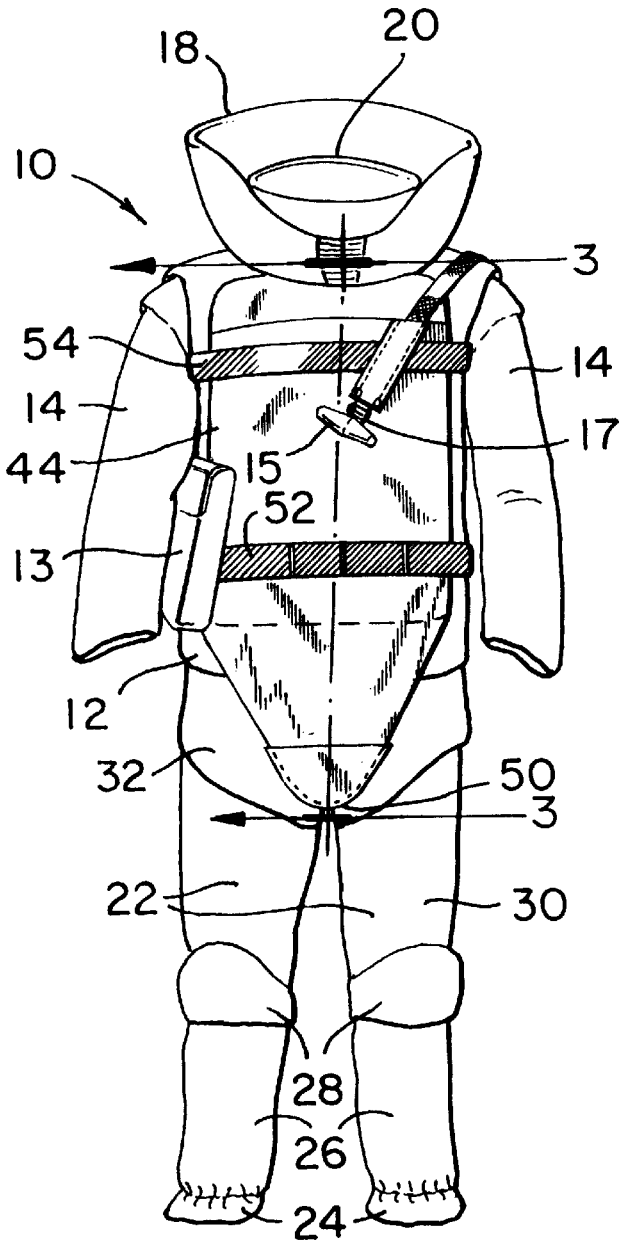
FIG. 1 is a front perspective view of a protective suit that includes a presently preferred embodiment of the invention.

In the drawings, the suit 10 is seen as comprising a jacket 12 for covering the shoulders and torso and including a pair of detachable sleeves 14 and a double collar arrangement comprising a wide high outer collar 18 which is somewhat scooped downwardly at the front and which is spaced around a shorter inner collar 20. The suit also includes trousers 22 which cover the legs from ankle to hip and each of which comprises at its lower end an ankle cover 24, a reinforced shin section 26 an enlarged knee cap 28, and a thigh section 30, the suit being completed by an integrated groin protector (IGP) in the form of shorts 32 which are pulled on over the trousers 22 and which extend upwardly under the lower end of the jacket 12, the shorts being adaptable to conform to the wearer by means of adjusting straps 34. The suit as described is designed to provide overall protection to the wearer from ankle to neck, and its components are consequently made of tough flexible material arranged in multi-layers to be resistant to penetration by flying fragments of mines, bombs and the like. The suit is furthermore protected in the regions thereof covering the vital organs (chest and groin), by the addition of reinforcement in the form of hard metal or composite plates for example in the shin sections 26, thigh sections 30, and the knee caps 28.

The front of the suit is reinforced by an enlarged breast plate 36 which covers over the major portion of the width of the torso and extends from the region of the collarbone to the waist. The breast plate is of generally rectangular outline with rounded corners, and the upper end may be concave as seen in FIG. 1 to accommodate the curvature of the outer collar 20. Since the breast plate is designed to provide protection to the vital organs of the wearer, it is of very strong construction being fabricated in multiple layers of reinforced fiber material such as aramid woven layers and will include rigid reinforcing layers of metal, or plastic composites or glass or polyethylene fiber and the like.

Figure 2:
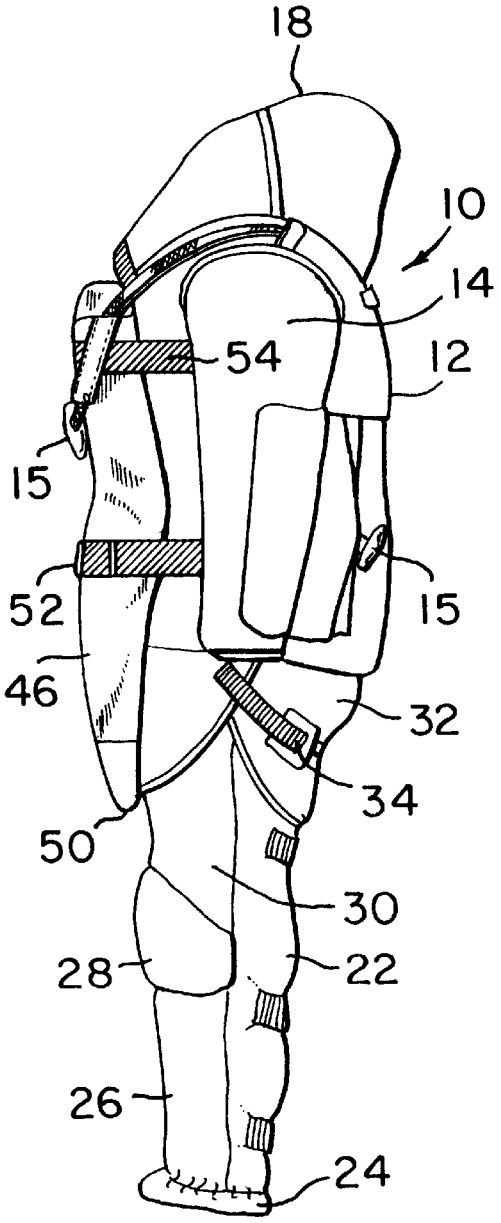
FIG. 2 is a side view corresponding to FIG. 1.

Also on the front of the suit is a further enhanced protection system comprising a groin plate 38 which is of similar construction to the breast plate 36 but which has a shape that tapers downwardly as seen in FIG. 1 to a rounded lower end 40. In the deployed position shown in FIG. 1, the groin plate extends downwardly with its lower end 40 positioned in front of the crotch region of the wearer, and as shown in FIG. 2 close to the thigh sections 30 of the trousers. In this position the upper edge 42 of the groin plate overlaps the lower marginal region of the breast plate 36 so that these two together provide continuous coverage at the front of the suit from the crotch region to the neck region.

Figure 3:
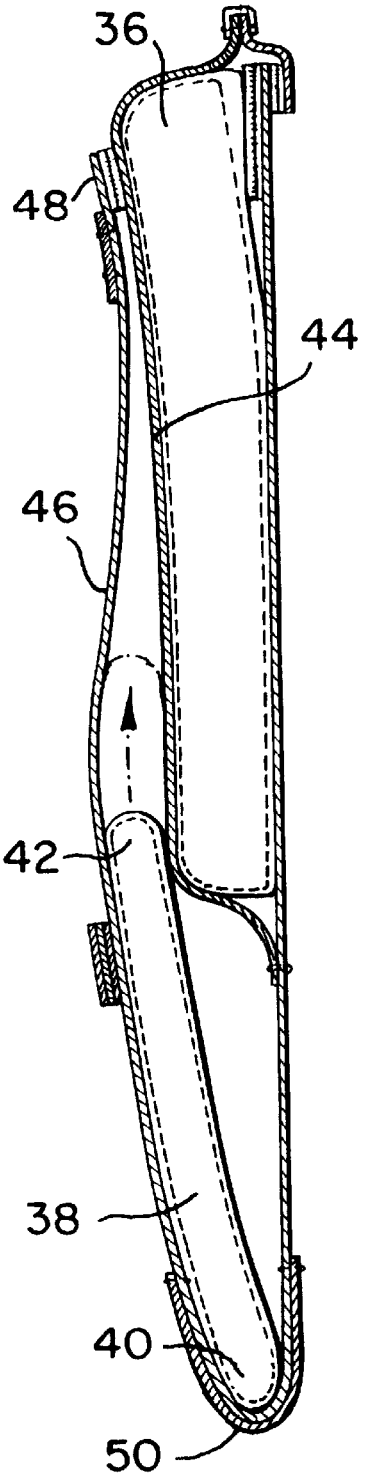
FIG. 3 is an enlarged fragmentary sectional view of the front of the suit as taken on the line 3—3 in FIG. 1.

The position of the breast plate 36 is fixed in relation to the suit, the breast plate being received within a fabric pouch 44 that is stitched to the front of the jacket 12. In front of the pouch 44 is a further pouch 46 made of fabric material, this pouch extending as shown in FIG. 3 from an upper end 48 which is attached near the top of the pouch 44 to a lower end 50 which as seen in FIG. 3 extends a considerable distance below the pouch 44. In the deployed condition, the groin plate 38 occupies the position shown in FIG. 3 and in FIGS. 1 and 2, and the pouch 46 is fully extended, the upper end of the groin plate 38 being maintained in contact with the lower marginal region of the breast plate 36 by the pouch, an utility holder and reinforcement strap 52 extending across the front of the pouch 46 being manipulated to maintain the groin plate 38 in the desired position. The lower end of the groin plate 38 is attached to the lower end of the pouch 46. An upper lateral reinforcement strap 54 reinforces the breast plate pouch.

Figure 4:
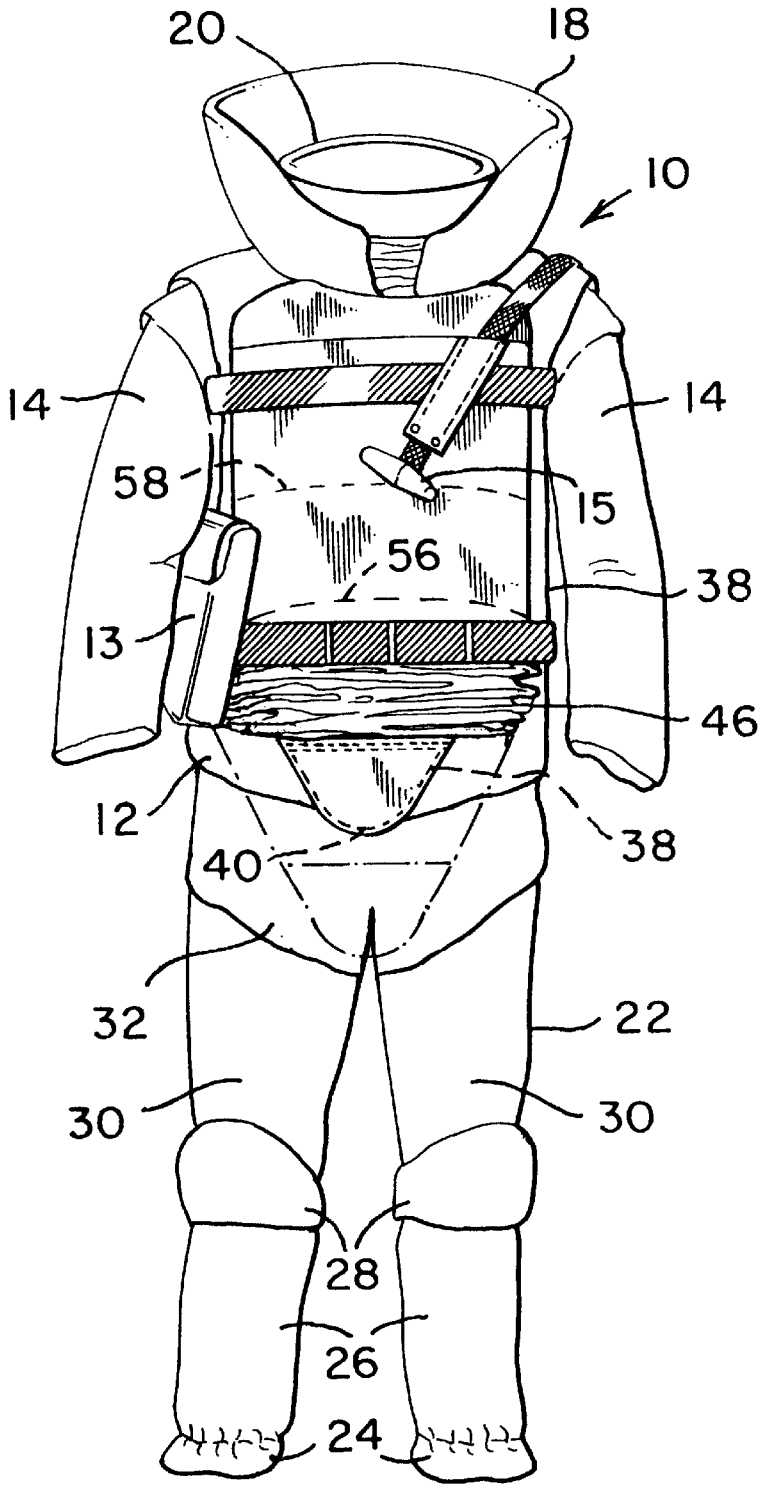
FIG. 4 is a slightly enlarged front view of the suit in an alternative position.

In the deployed position the groin plate 38 provides a high degree of protection to the vital groin area of the wearer. However it is comparatively bulky and greatly interferes with the freedom of movement of the wearer of the suit since it will constantly be impacted by the thigh portions 30 in any normal walking action of the wearer, and accordingly restricts the movement of the legs of the wearer, in particular making it more difficult for the wearer to lift either leg, e.g. when an obstacle must be surmounted. Likewise the deployed groin plate will restrict the freedom of movement of the wearer of the suit when he wants to assume a crouched or kneeling position. To overcome this problem the groin plate 38 is arranged to be retractable, i.e. to be movable upwardly into an increasing overlapping position with respect to the breast plate 36 as indicated in by the arrow in FIG. 3, so that ultimately the lower end 40 of the groin plate is located substantially at waist level as seen in FIG. 4, the pouch 46 being of flexible material assuming a folded and shirred configuration as shown in FIG. 4 to accommodate upwards movement of the groin plate. In this upwardly displaced position the groin plate is retained in frictional engagement against the front of the breast plate, and no special measures are necessary otherwise to secure the groin plate in the retracted position thereof. However if desired straps or other fasteners (not shown) could be provided to retain the groin plate in its upwardly retracted position. In the position as shown in FIG. 4, the lower end 40 of the groin plate is sufficiently raised such that it provides little or no impediment to normal leg movements of the wearer. Thus by arranging for the groin plate 38 to be retractable the convenience of using the overall protective suit is greatly enhanced.

The jacket 12 also carries a pouch 13 for carrying a battery pack or like, and includes a toggle 15 that is connected to a quick release strap 17, a similar toggle and strap arrangement 15 being provided on the back of the jacket to enable it to be divested very quickly should this be warranted.

We claim:

1. A protective suit for covering a body and limbs of an operative to shield the body and limbs from effects of explosive devices such as anti-personnel mines and the like, the protective suit comprising:

a front region that carries a reinforced breast plate sized and located to provide protection to a chest area of the operative, a lower end of the breast plate being disposed in use at a waist region of the operative; and a reinforced groin plate suspended in the front region by a retractable carrier and being movable between a deployed position wherein the groin plate is disposed in front of a groin region of the operative and extends from a waist to below a crotch region with an upper end of the groin plate being in register with the lower end of the breast plate, and a retracted position wherein the groin plate partially overlies the breast plate and thus does not inhibit freedom of movement of legs of the operative.

2. A protective suit as claimed in claim 1, wherein the retractable carrier comprises a pouch of flexible material within which the groin plate is contained, the pouch extending in front of and below the breast plate, the flexible material being collapsible to accommodate movement of the groin plate between the deployed and retracted positions, and in the deployed position supporting the groin plate against further downwards movement thereof.

3. A protective suit as claimed in claim 2, wherein the pouch defines a pocket which overlies the breast plate and into which the groin plate is raised in moving to the retracted position, the pocket being configured so as to maintain the groin plate, when retracted, in contact with the breast plate.

4. A protective suit as claimed in claim 2, wherein the groin plate when retracted lies in light frictional engagement with the breast plate and the pouch, the engagement being sufficient to retain the groin plate in the retracted position when the pouch is tilted forwardly as when the operative assumes a bent over or crouched position, and being insufficient to retain the groin plate in the retracted position when the pouch assumes an upright position.

5. A protective suit as claimed in claim 2, wherein a lower part of the groin plate is attached to the flexible material of the pouch.

6. A protective suit as claimed in claim 1, wherein the groin plate when in the deployed position is angled rearwardly in downwards direction such that a lower end of the groin plate is in close proximity to the legs of the operative.

7. A protective suit as claimed in claim 1, wherein the groin plate curves rearwardly towards a tapered lower end thereof.

8. A protective suit as claimed in claim 1, wherein in the deployed position, the upper end of the groin plate overlaps the lower end of the breast plate to an extent of at least 25 mm.

9. A protective suit as claimed in claim 8, wherein the groin plate, when in the deployed position, is angled rearwardly in downwards direction such that a lower end of the groin plate is in close proximity to the legs of the operative.

10. A protective suit as claimed in claim 8, wherein the retractable carrier comprises a pouch of flexible material within which the groin plate is contained, the pouch extending in front of and below the breast plate, the flexible material of the pouch being collapsible to accommodate movement of the groin plate between the deployed and retracted positions, and in deployed position supporting the groin plate against further downwards movement.

11. A protective suit as claimed in claim 8, wherein a lower end of the groin plate is tapered and wherein the groin plate is curved rearwardy from top to bottom.

12. A protective suit as claimed in claim 11, wherein the retractable carrier comprises a pouch of flexible material within which the groin plate is contained, the pouch extending in front of and below the breast plate, the flexible material of the pouch being collapsible to accommodate movement of the groin plate between the deployed and retracted positions, and in the deployed position supporting the groin plate against further downwards movement thereof.

13. A protective suit as claimed in claim 1, wherein in the retracted position, a lower end of the groin plate is above the crotch region and substantially at a waist level of the operative.

14. A protective suit for covering a body and limbs of an operative to shield the body and limbs from effects of explosive devices such as anti-personnel mines and the like, the protective suit comprising:

a front region that carries a reinforced breast plate sized and located to provide protection to a chest area of the operative, a lower end of the breast plate being disposed in use at a waist region of the operative;

a reinforced groin plate suspended in the front region by a retractable carrier and being movable between a deployed position wherein the groin plate is disposed in front of a groin region of the operative and extends from a waist to below a crotch region with an upper end of the groin plate being in register with a lower end of a chest plate, and a retracted position wherein the groin plate substantially overlies the chest plate and thus provides less inhibition to freedom of movement of legs of the operative;

the retractable carrier comprising a pouch of flexible material within which the groin plate is contained, the pouch extending in front of and below the breast plate, the flexible material of the pouch being collapsible to accommodate movement of the groin plate between the deployed and retracted positions, and in the deployed position supporting the groin plate against further downwards movement thereof; and wherein in front of the breast plate, the pouch defines a pocket which overlies the breast plate and into which the groin plate is raised in moving to the retracted position wherein the groin plate is held by the pocket in frictional engagement with the breast plate.

15. A protective suit as claimed in claim 14, wherein the frictional engagement with the breast plate is sufficient to retain the groin plate in the retracted position when the pouch is tilted forwardly as when the operative assumes a bent over or crouched position, but is insufficient to retain the groin plate in the retracted position when the pouch assumes an upright position, whereupon the groin plate slides towards the deployed position under a force of gravity.

16. A protective suit as claimed in claim 14, wherein a lower part of the groin plate is attached to the flexible material of the pouch.

17. A protective suit as claimed in claim 14, wherein in the deployed position, an upper end of the groin plate overlaps the lower end of the breast plate by at least about 25 mm, and in the retracted position, a lower end of the groin plate is located substantially at waist level of the operative.

* * * * *

UNITED STATES PATENT AND TRADEMARK OFFICE

CERTIFICATE OF CORRECTION

PATENT NO. : 5,966,747

DATED : OCTOBER 19, 1999

INVENTOR(S) : CRUPI ET AL.

It is certified that error appears in the above-identified patent and that said Letters Patent is hereby corrected as shown below:

Front page, [56] References Cited, U.S. Patent Documents: insert the following references:
—D166,904 6/1952 Bridges—
—4,901,370 2/1990 Suda—
—5,421,326 6/1995 Rankin et al.—

Signed and Sealed this

Third Day of April, 2001

*Attest:*

Nicholas P. Godici

NICHOLAS P. GODICI

*Attesting Officer*

*Acting Director of the United States Patent and Trademark Office*